US005653612A

United States Patent [19]

Peterson et al.

[11] Patent Number: 5,653,612

[45] Date of Patent: Aug. 5, 1997

[54] ELECTRICAL CONTACT ASSEMBLY WITH STABILIZING CONTACT MOUNT

[75] Inventors: Carl C. Peterson, Danbury; Frederick D. Hooper, Norwalk, both of Conn.; Forest W. Whitesel, Lewisberry, Pa.

[73] Assignee: Framatome Connectors USA Inc., Norwalk, Conn.

[21] Appl. No.: 515,240

[22] Filed: Aug. 15, 1995

[51] Int. Cl.[6] ..... H01R 13/428

[52] U.S. Cl. ..... 439/745; 439/871

[58] Field of Search ..... 439/744, 745, 439/871, 872, 873

[56] References Cited

U.S. PATENT DOCUMENTS

| | | | |
|---|---|---|---|
| 4,358,179 | 11/1982 | Bourdon et al. | 439/595 |
| 4,701,004 | 10/1987 | Yohn | 439/744 |
| 5,324,215 | 6/1994 | Walkup et al. | 439/857 |
| 5,380,226 | 1/1995 | Anderson | 439/724 |
| 5,395,252 | 3/1995 | White | 439/66 |

FOREIGN PATENT DOCUMENTS

| | | |
|---|---|---|
| 0516937 | 12/1992 | European Pat. Off. . |
| WO 90/07807 | 7/1990 | WIPO . |

*Primary Examiner*—Neil Abrams
*Assistant Examiner*—T. C. Patel
*Attorney, Agent, or Firm*—Perman & Green

[57] ABSTRACT

An electrical connector with a housing and a plurality of contact assemblies. Each contact assembly has a contact and a contact mount. Both the contact and the contact mount are generally tubular shaped. The contact mount surrounds a substantial portion of the contact and has tabs that are bent into a slot in the contact to fixedly and stationarily attach the contact mount to the contact. A front end of the contact mount has a latch that latches behind a portion of the housing. A rear end of the contact mount has a stabilizer cone that circumferentially contacts the housing to stabilize the assembly inside the housing.

25 Claims, 3 Drawing Sheets

ELECTRICAL CONTACT ASSEMBLY WITH STABILIZING CONTACT MOUNT

BACKGROUND OF THE INVENTION

1. Field of the Invention

This invention relates to electrical connectors and, more particularly, to an electrical contact assembly having a stabilizing contact mount.

2. Prior Art

U.S. Pat. No. 5,380,226 discloses a contact spacer that surrounds female contacts inside a housing. U.S. Pat. Nos. 5,324,215 and 5,395,252 disclose contacts made from sheet metal that is cut and formed.

SUMMARY OF THE INVENTION

In accordance with one embodiment of the present invention a contact mount for mounting a contact inside a connector housing is provided comprising means for fixedly connecting the contact mount around the contact, a stabilizer section, and means for fixedly connecting the contact mount to the connector housing. The stabilizer section is adapted to have its sides inwardly deflected by insertion into a contact receiving area of the connector housing.

In accordance with another embodiment of the present invention a contact mount for mounting a contact to a contact housing is provided. The contact mount comprises means for fixedly connecting the contact mount to the contact housing inside a contact receiving area, and opposing tabs. The opposing tabs are in a center of the contact mount. The tabs are inwardly deflectable to project into the contact and thereby fixedly mount the contact mount to the contact.

In accordance with another embodiment of the present invention a contact assembly is provided comprising a contact and a contact mount. The contact has a generally tubular shape. The contact mount is for mounting the contact in a connector housing. The contact mount surrounds the contact along a substantial portion of its length. The contact mount has opposing tabs that are bent into a receiving slot through the contact to thereby fixedly connect the contact mount to the contact.

In accordance with another embodiment of the present invention an electrical connector is provided comprising a housing and a contact assembly located in the housing. The contact assembly has a contact and a contact mount. Both the contact and the contact mount have general tubular shapes. The contact mount surrounds a portion of the contact and has tabs that project into an interior of the contact to thereby fixedly mount the contact mount to the contact.

In accordance with another embodiment of the present invention an electrical connector is provided comprising a housing and a contact assembly connected to the housing. The housing has contact receiving channels. The contact assembly is mounted inside one of the contact receiving channels. The contact assembly has a contact and a contact mount. The contact mount is connected to the contact and surrounds a substantial portion of the contact along its length. The contact mount has a rear end stabilizer section that circumferentially engages the housing in the contact receiving channel and a front end latch that is latched in front of a portion of the housing.

In accordance with one method of the present invention a method of assembling a contact assembly is provided comprising steps of forming a general tubular contact from a sheet of flat metal material; forming a general tubular contact mount from a sheet of flat metal material; inserting the contact into the contact mount; and deflecting tabs on the contact mount into a slot in the contact to thereby fixedly mount the contact mount onto the contact.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
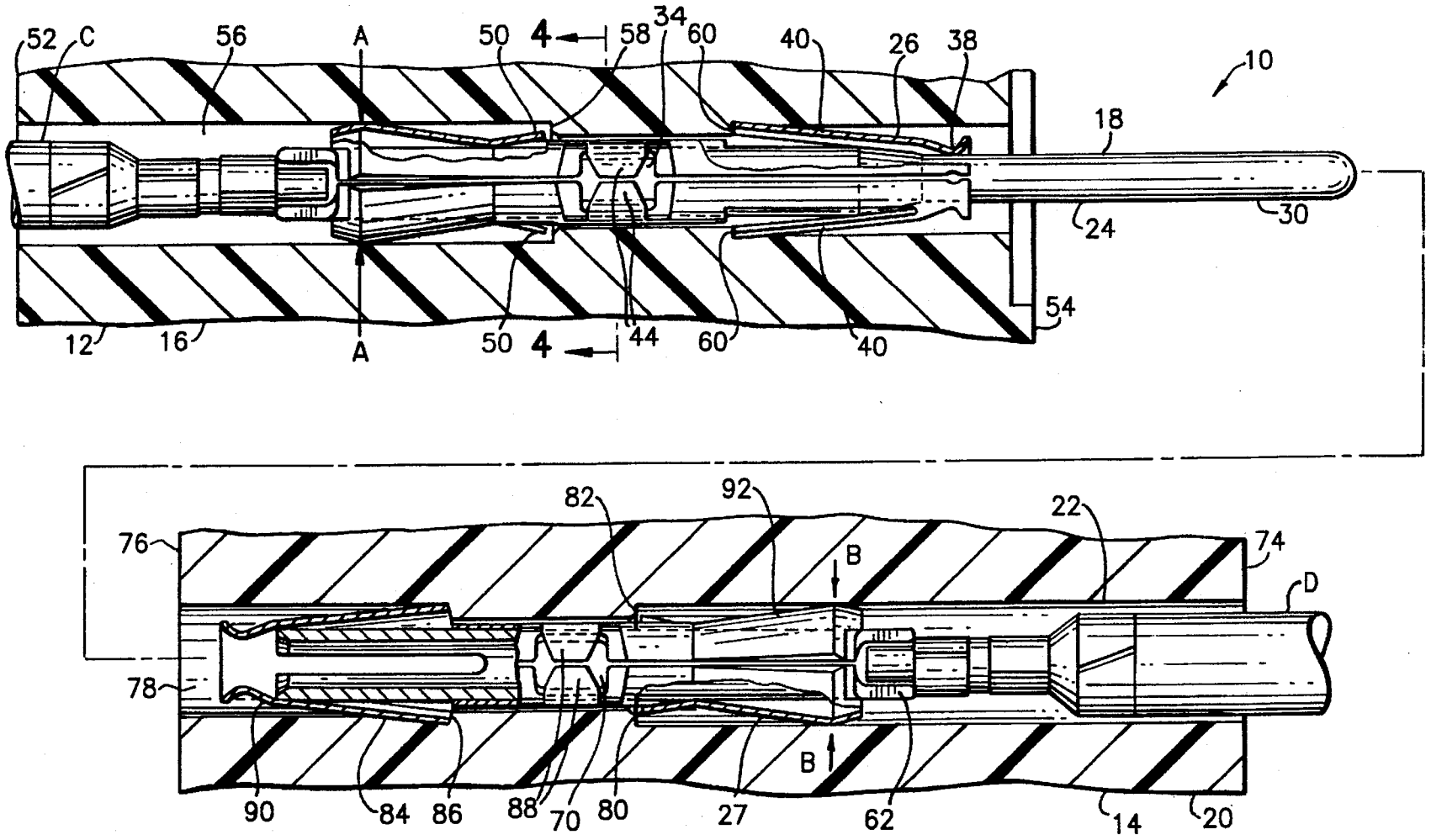
FIG. 1 is a partial cross-sectional view of portions of two electrical connectors incorporating features of the present invention.

Referring to FIG. 1, there is shown a partial cross-sectional view of portions of a connector assembly 10 incorporating features of the present invention. Although the invention will be described with reference to the embodiment shown in the drawings, it should be understood that features of the present invention can be embodied in various different forms of alternate embodiments. In addition, any suitable size, shape or type of elements or materials could be used.

Figure 2:
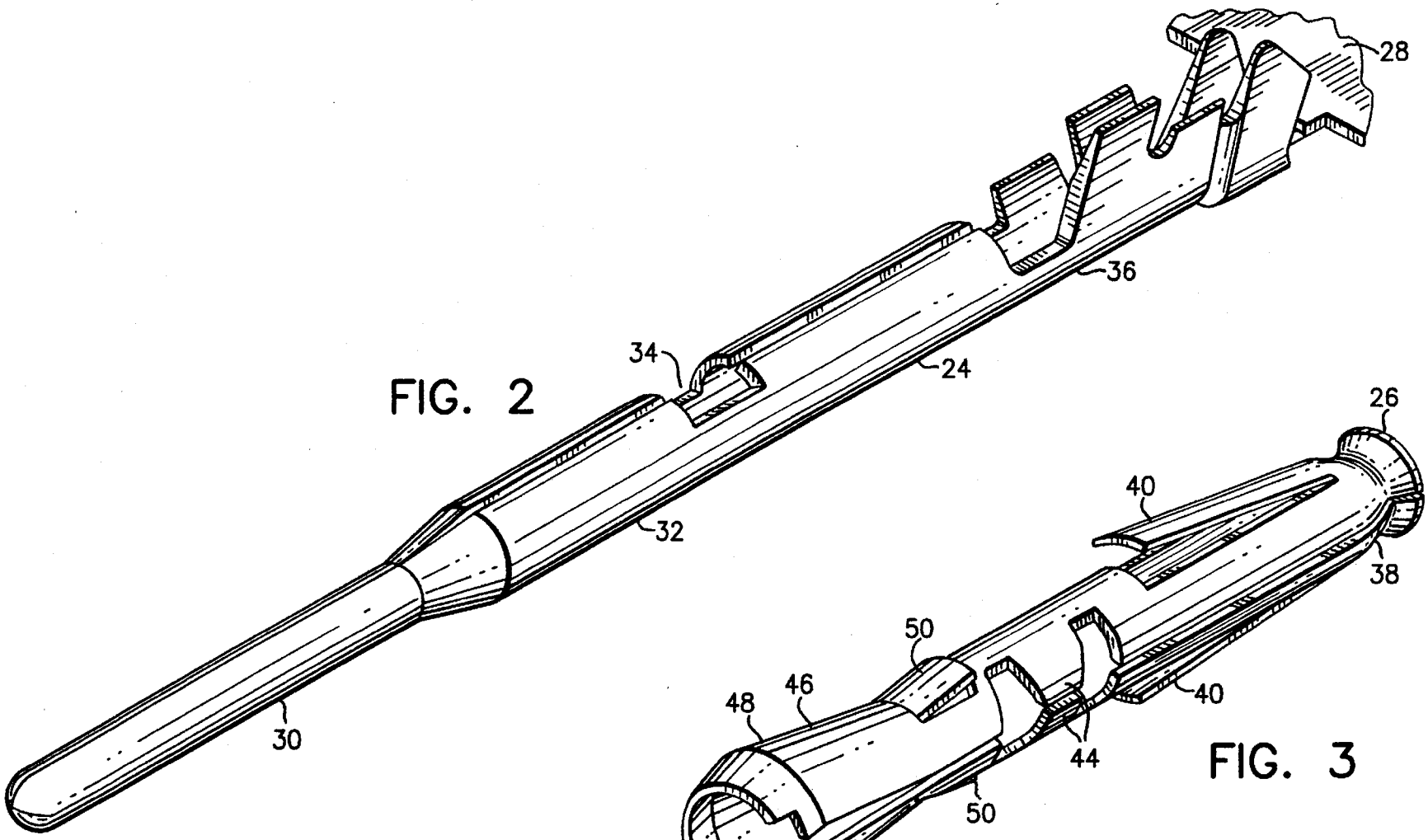
FIG. 2 is a perspective view of a male contact used in one of the contact assemblies shown in FIG. 1.
Figure 3:
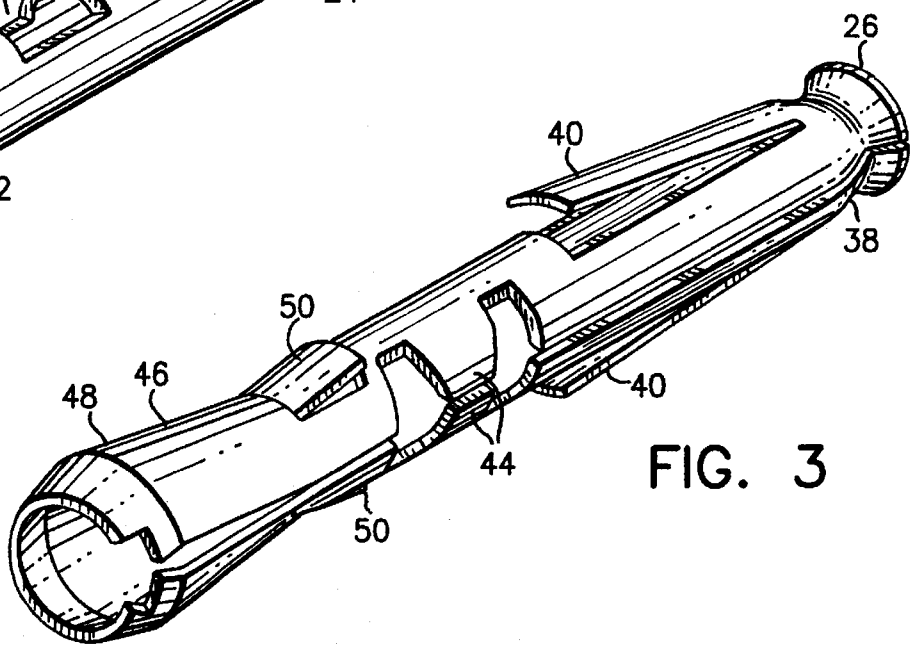
FIG. 3 is a perspective view of a contact mount used in the contact assemblies shown in FIG. 1.

The connector assembly 10 includes two electrical connectors 12, 14. The first connector 12 has a first housing 16 and male electrical contact assemblies 18 (only one of which is shown). The second connector 14 has a second housing 20 and female electrical contact assemblies 22 (only one of which is shown). Referring also to FIGS. 2 and 3, the male contact assembly 18 includes a male contact 24 and a contact mount 26. The male contact 24 is comprised of flat sheet metal material that is cut and formed into the shape shown. FIG. 2 shows the male contact 24 attached to a carry strip 28 which is severed from the contact 24 after the contact 24 is inserted into the first housing 16.

When the male contact 24 is formed, it is formed with a general elongate tubular shape. A front end 30 is adapted to be inserted into the female contact assembly 22. A middle section 32 has a slot 34. A rear end 36 is adapted to have a conductor C fixedly attached thereto. However, in alternate embodiments, other suitable types of male contacts could be provided.

The contact mount 26 is also comprised of flat sheet metal material that is cut and formed into the shape shown. When the contact mount 26 is formed, it is formed with a general tubular shape. The front end 38 of the mount 26 has two outwardly formed deflectable cantilevered latch arms 40 extending in a rearward direction. Location in a middle section 42 of the mount 26 are two opposing tabs 44. FIG. 3 shows the mount 26 prior to connection to the male contact 24. The rear end 46 of the mount 26 includes a cone shaped stabilizer section 48 and stop tabs 50.

Figure 4:
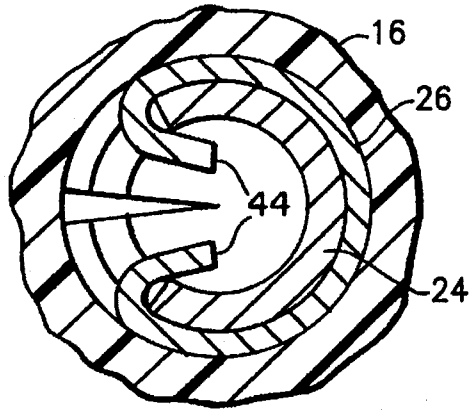
FIG. 4 is a cross-sectional view of the male contact assembly shown in FIG. 1 taken along line 4—4.

The contact mount 26 is mounted on and surrounds a substantial portion of the male contact 24. As seen in FIG. 4, the tabs 44 are aligned with the contact slot 34 and deflected or bent into the slot 34. This fixedly attaches the contact mount 26 on the contact 24. The tabs 44 have a tapered shape. This feature assists to remove problems that might otherwise occur because of manufacturing tolerances of the contact mount 26 and male contact 24. In other words, the tapered tabs 44 remove assembly tolerance problems between the contact mount 26 and the contact 24. As the tabs 44 are deformed into the slot 34, their widening tapered edges become snugly seated in the fixed width slot 34. This securely connects the contact mount 26 fixedly on the male contact 24. The horn shaped aperture at the front end 38 of the contact mount 26 contacts and stabilizes the male contact 18 inside the contact mount 26.

With the mount 26 fixedly connected to the contact 24, the male contact assembly 18 is then inserted into the first housing 16. The first housing 16 is comprised of dielectric material with a rear end 52, a front mating end 54, and contact receiving areas 56 (only one of which is shown). The male contact assembly 18 is inserted through the rear end of the receiving area 56 until stop tabs 50 are stopped by the ledge 58. The latch arms 40 deflect inward and then snap outward again during insertion to locate the latch arms 40 in front of the ledge 60. The stop tabs 50 and latch arms 40 cooperate with the ledges 58, 60 to retain the male contact assembly 18 in the receiving area 56.

During insertion of the male contact assembly 18 into the first housing 16, the cone shaped stabilizer section 48 makes circumferential contact with the housing 16 inside the receiving area 56. More specifically, the stabilizer section 48 is slightly compressed as shown by arrows A in FIG. 1. This compression mounting of the stabilizer section 48 in combination with spring loading of the latch arms 40 laterally against the housing 16, stably mounts the male contact assembly 18 in the receiving area 56. This prevents the elongate contact assembly 18 from being canted or titled. Tilting of the plurality of contact assemblies 18 could otherwise inhibit connection to the second connector 14. Thus, the mount 26 functions to keep the male contact 18 coaxially aligned, or at least parallel, with the axis of the receiving area 56.

Figure 5:
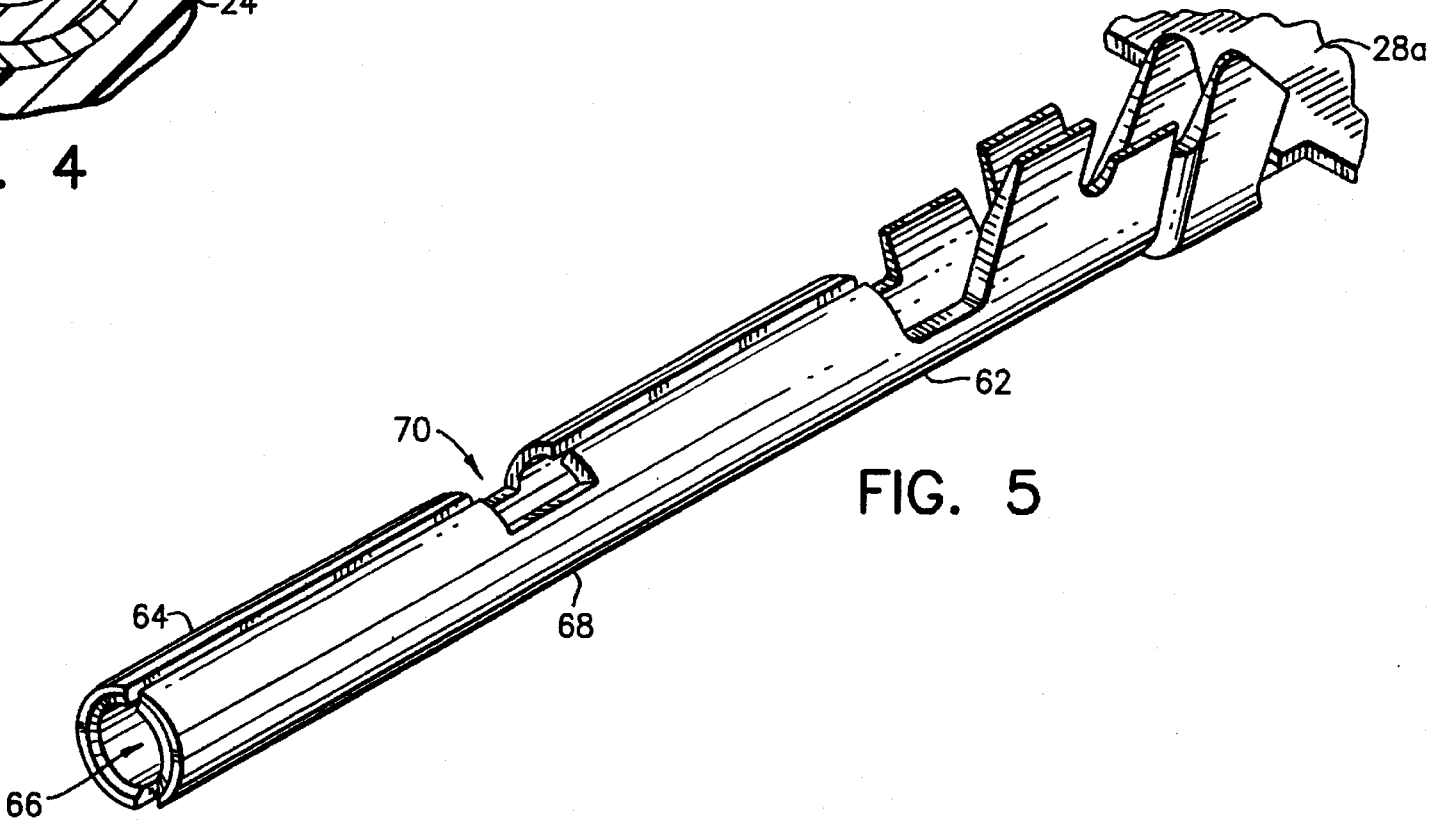
FIG. 5 is a perspective view of a female contact used in one of the contact assemblies shown in FIG. 1.

Referring to FIGS. 1, 3 and 5, the female contact assembly 22 comprises a female contact 62 and a contact mount 27. The contact mount 27 is the same as the contact mount 26. Therefore, a single type of contact mount is used for both the male contact assembly 18 and the female contact assembly 22. With particular reference to FIG. 5, the female contact 62 is comprised of flat sheet metal material that is cut and formed into the shape shown. A plurality of female contacts 62 are formed with a carry strip 28*a* which is severed from the contacts 62 after the contacts 62 are inserted into the second housing 20.

When the female contact 62 is formed, it is formed with a general elongate tubular shape. A front end 64 is adapted to matingly receive the front end 30 of the male contact 24 inside the interior channel 66. A middle section 68 has a slot 70. A rear end 72 is adapted to have a conductor D fixedly attached thereto. However, in alternate embodiments, other suitable types of female contacts could be provided.

The contact mount is mounted on and surrounds a substantial portion of the female contact 62. Similar to that shown in FIG. 4, the tapered tabs 88 of the contact mount 27 are aligned with the contact slot 70 and deflected or bent into the slot 70. This fixedly attaches the contact mount 27 on the female contact 62. The tapered nature of the tabs 88, similar to the tabs 44, remove assembly tolerance problems between the contact mount 27 and the female contact 62. The horn shaped aperture at the front end 90 of the contact mount contacts and stabilizes the front end of the female contact 62 inside the contact mount 27. With the mount 27 fixedly attached to the female contact 62, the female contact assembly 22 is then inserted into the second housing 20.

The second housing 20 is comprised of dielectric material with a rear end 74, a front mating end 76, and contact receiving areas 78 (only one of which is shown). The female contact assembly 22 is inserted through the rear end of the receiving area 78 until stop tabs 80 are stopped by the ledge 82. The latch arms 84 deflect inward and then snap outward again during insertion to locate the latch arms 84 in front of the ledge 86. The stop tabs 80 and latch arms 84 cooperate with the ledges 82, 86 to retain the female contact assembly 22 in the receiving area 78.

During insertion of the female contact assembly 22 into the second housing 20, the cone shaped stabilizer section 92 makes circumferential contact with the second housing 20 inside the receiving area 78. More specifically, the stabilizer section 92 is slightly compressed as shown by arrows B in FIG. 1. This compression mounting of the stabilizer section 92 in combination with spring loading of the latch arms 84 laterally against the housing 20, stably mounts the female contact assembly 22 in the receiving area 78. This prevents the elongate contact assembly 22 from being canted or tilted. Tilting of the plurality of contact assemblies 22 could otherwise inhibit connection to the first connector 12. Thus, the mount 27 functions to keep the female contact 22 coaxially aligned, or at least parallel, with the axis of the receiving area 78.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A contact mount for mounting a contact inside a connector housing, the contact mount comprising:

means for fixedly connecting the contact mount around the contact, the means for fixedly connecting having a tab on the contact mount that is bent to project into a slot in the contact;

a stabilizer section adapted to have its sides inwardly deflected by insertion into a contact receiving area of the connector housing; and means for fixedly connecting the contact mount to the connector housing.

2. A contact mount as in claim 1 wherein the contact mount has a general tubular shape.

3. A contact mount as in claim 1 wherein the means for fixedly connecting the contact mount around the contact includes the contact mount having a second tab, wherein the two tabs oppose each other and are deflected through the slot in the contact.

4. A contact mount as in claim 1 further comprising a horn shaped front aperture.

5. A contact mount as in claim 1 wherein the contact mount is comprised of flat sheet metal that is cut and formed into a general tubular shape.

6. A contact mount as in claim 1 wherein the means for fixedly connecting the contact mount to the connector housing includes deflectable cantilevered latch arms extending in a rearward direction from a front of the contact mount.

7. A contact mount as in claim 6 wherein the means for fixedly connecting the contact mount to the connector housing includes laterally extending stop tabs at a rear section of the contact mount.

8. A contact mount for mounting a contact to a connector housing, the contact mount comprising:

means for fixedly connecting the contact mount to the connector housing inside a contact receiving area; and opposing tabs in a center of the contact mount that are inwardly deflectable to project into the contact and thereby fixedly mount the contact mount to the contact.

9. A contact mount as in claim 8 wherein the contact mount is comprised of a flat sheet of metal that is cut and formed into a general tubular shape.

10. A contact mount as in claim 9 wherein the contact mount has a front aperture with a general horn shape.

11. A contact mount as in claim 10 wherein a rear end of the contact mount has a general cone shaped stabilizer section adapted to be circumferentially compressed inside a receiving area of a housing.

12. A contact mount as in claim 11 wherein the means for fixedly connecting includes deflectable cantilevered latch arms extending in a rearward direction from a front end of the contact mount.

13. A contact assembly comprising:

a contact having a generally tubular shape; and a contact mount for mounting the contact in a connector housing, the contact mount surrounding the contact along a substantial portion of its length, the contact mount having opposing tabs that are bent into a receiving slot through the contact to thereby fixedly connect the contact mount to the contact.

14. A contact assembly as in claim 13 wherein both the contact and the contact mount are comprised of flat sheet metal that is cut and formed into general tubular shapes.

15. A contact assembly as in claim 13 wherein the contact mount has an outwardly extending stabilizer section at its rear end adapted to contact a connector housing in a contact receiving area.

16. A contact assembly as in claim 15 wherein the stabilizer section has a general cone shape.

17. A contact assembly as in claim 15 wherein the contact mount includes a latch at its front end adapted to latch behind a portion of the connector housing.

18. A contact assembly as in claim 16 wherein the contact mount has a horn shaped aperture at its front end.

19. An electrical connector comprising:

a housing; and a contact assembly located in the housing, the contact assembly having a contact and a contact mount, both the contact and the contact mount having general tubular shapes with the contact mount surrounding a portion of the contact, the contact mount having tabs that project into an interior of the contact to thereby fixedly mount the contact mount to the contact.

20. An electrical connector as in claim 19 wherein the contact mount includes a rear end stabilizer section and a front end latching section for mounting the assembly to the housing.

21. An electrical connector comprising:

a housing having contact receiving channels; and a contact assembly connected to the housing inside one of the contact receiving channels, the contact assembly having a contact and a contact mount, the contact mount being connected to the contact and surrounding a substantial portion of the contact's length, the contact mount having a general cone shaped rear end stabilizer section that is circumferentially compressed by the housing in the contact receiving channel and a front end latch that is latched in front of a portion of the housing.

22. An electrical connector as in claim 21, wherein the contact mount has a horn shaped aperture at its front end that stabilizes a front end of the contact inside the contact mount.

23. A method of assembling a contact assembly comprising steps of:

forming a generally tubular contact from a sheet of flat metal material;

forming a general tubular contact mount from a sheet of flat metal material;

inserting the contact into the contact mount; and deforming tabs on the contact mount into a slot in the contact to thereby fixedly mount the contact mount onto the contact.

24. A method as in claim 23 wherein the step of forming the contact forms a contact with a front male contact area.

25. A method as in claim 23 wherein the step of forming a contact forms the contact with a front female contact area.

* * * * *